US007510453B2

(12) United States Patent
Nguyen

(10) Patent No.: US 7,510,453 B2
(45) Date of Patent: Mar. 31, 2009

(54) SWIMMING AID DEVICE

(76) Inventor: Andrew Nguyen, 2060 Mangrum Ct., La Habra, CA (US) 90631

( * ) Notice: Subject to any disclaimer, the term of this patent is extended or adjusted under 35 U.S.C. 154(b) by 0 days.

(21) Appl. No.: 11/841,665

(22) Filed: Aug. 20, 2007

(65) Prior Publication Data

US 2009/0053947 A1 Feb. 26, 2009

(51) Int. Cl.
*A63B 31/08* (2006.01)

(52) U.S. Cl. ..... 441/64; 441/61

(58) Field of Classification Search ..... 441/60–64; D21/806

See application file for complete search history.

(56) References Cited

U.S. PATENT DOCUMENTS 3,165,764 A * 1/1965 Christiansen ..... 441/63
3,521,312 A * 7/1970 Ganev ..... 441/64
4,781,637 A * 11/1988 Caires ..... 441/61

* cited by examiner

*Primary Examiner*—Ed Swinehart
(74) *Attorney, Agent, or Firm*—Buus, Kim, Kuo & Tran APC; John D. Tran

(57) ABSTRACT

A swimming aid device comprising of a convertible bi/mono swim fin containing a first fin, a second fin and coupling means. The present invention can be used as traditional independent swim fins or combined together to form a bi-swim fin in which both swim fins are held together to aid the swimmer in performing feet unison-style swim kicks such as a dolphin kick.

In one embodiment, the coupling means consists of a track and rail in which a track is attached to a first fin and a rail is attached to a second fin. Said track of the first fin has an inner groove that can slidably receive the rail of the second fin.

The swimming aid device further comprising a locking means for selective locking of the rail to the groove so that once the rail is slidably and fully received within said groove, said locking means prevents further relative sliding movement between said rail and said groove.

6 Claims, 11 Drawing Sheets

SWIMMING AID DEVICE

FIELD OF THE INVENTION

This invention is in the field of swim fins, in particular to a swimming aid device comprising of a convertible bi/mono swim fin.

BACKGROUND OF THE INVENTION

It can be appreciated that swim fins have been around for many years. Swim fins are typically designed to increase the swimmers mobility and speed in the water while decreasing the amount of energy the swimmers need to exert in the water. Various designs of swim fins exist in the market today such as U.S. Pat. No. 6,979,241 to Hull, U.S. Pat. No. 5,387,145 to Wagner (all hereby incorporated by reference) and are intended for the user to wear each swim fin on each individual foot. Although these previous swim fins may address the needs listed above, they are typically limited in the fact that are primarily directed to swimming techniques and style that involve typical independent movement or kicking of both feet when swimming. However, there are a variety of swim styles that require swim kicks that involve both feet to act in concert with each other. For example, a dolphin kick is a common swimming kick used mainly by swimmers using the butterfly swimming style in which the legs are extended straight back and moved up and down in unison with a slight bend in the knees on the downward movement. To maximize the efficiency, speed and power of such swimming techniques as the dolphin kick, the ability to keep both feet as close as possible and having them function in unison is vital to the success of swimming forms such as the butterfly. However, swimmers using the previously known swim fins often find great difficulty in successfully performing such unison-style swim kicks, such as a dolphin kick, because of the tendency of the independent swim fins to separate during kicking and thus leading to less control, decreasing speed, efficiency and power.

While these devices may be suitable for the particular purpose to which they address, they are not suitable for incorporating the advantages of a swimming aid device which comprises a convertible bi/mono swim fin, which can be used as traditional independent swim fins or combined together to form a bi-swim fin in which both swim fins are held together to aid the swimmer in performing feet unison-style swim kicks such as a dolphin kick.

In these respects, the swimming aid device according to the present invention substantially departs from the conventional concepts and designs of the prior art, and in so doing provides a storage system that is not anticipated, rendered obvious, suggested, or even implied by any of the prior art storage systems either alone or in combination thereof.

SUMMARY OF THE INVENTION

In view of the foregoing disadvantages inherent in the known types of swimming aid devices now present in the prior art, the general purpose of the present invention, which will be described subsequently in greater detail, is to provide a swimming aid device which comprises a convertible bi/mono swim fin.

Further, the present invention achieves the desired characteristics using fewer parts than required in the above designs described above.

Another object of the present invention is to provide a swimming aid device that the swim fins are capable of easily being attached and unattached by the user;

Another object of the present invention is to provide a swimming aid device that is relatively easy and inexpensive to manufacture;

Another object of the present invention is to provide a swimming aid device that can be modified and situated to accommodate various feet sizes of the user;

Another object of the present invention is to provide a swimming aid device that is relatively lightweight yet durable and waterproof; Another object of the present invention is to provide a swimming aid device that contains a coupling mechanism that minimizes or negates the need of moving parts;

To attain this, the present invention generally comprises a first fin, a second fin, and a coupling means for coupling said first fin to said second fin. In one embodiment, the coupling means can be comprised of a locking means to prevent unwanted movement of the fins after coupling is achieved. In one embodiment, the coupling means includes a track and rail, wherein the track is disposed on a lateral side of the first fin and has a groove running in a longitudinal direction substantially parallel to a longitudinal axis of the track. The groove slidably receives the rail where the rail is disposed on a lateral side of the second fin.

In typical use, a user would insert his/her feet into each opening of the swim fins as is typically done. The user can then decide either to couple or combine the individual swim fins into one joined swim fin or keep the swim fins separate and use them as traditional independent swim fins. Further, the user may always attach or detach the swim fins at anytime in or out of the water by using the swimming aid device's coupling mechanism, which can be done by the user's feet. In one embodiment, where the swimming aid device's coupling mechanism includes a track and rail; the user would slidably connect or couple one swim fin into the other swim fin to create a mono-fin and do the reverse to obtain independent bi-fins. However, it should be noted that the coupling means may comprise of other configurations besides a track and rail type of coupling.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting. To accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
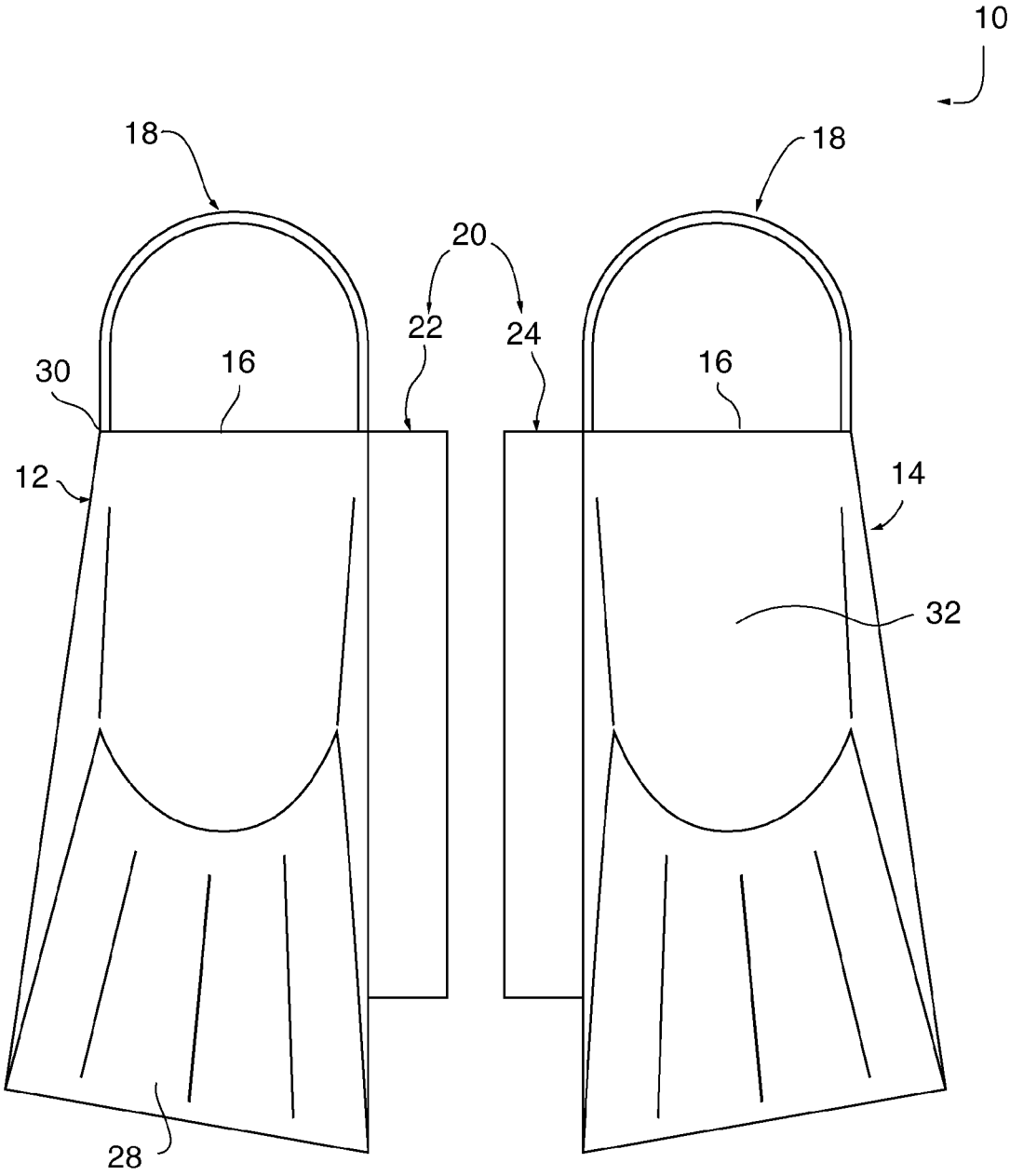
FIG. 1 is a top down perspective view of the swimming aid device.
Figure 2:
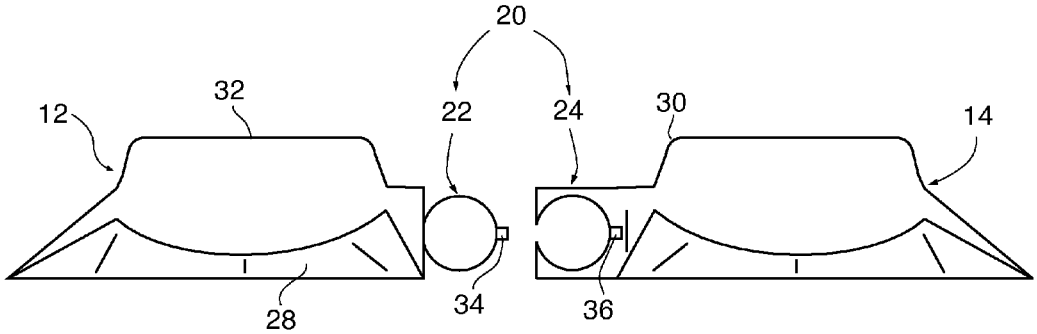
FIG. 2 is a front view of the swimming aid device showing an embodiment of the coupling means.
Figure 3:
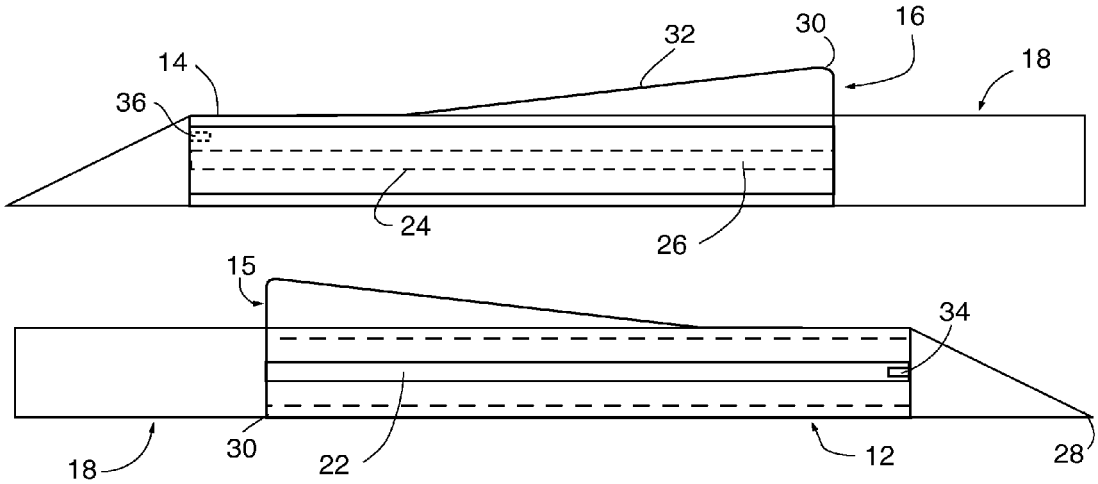
FIG. 3 is a side view of the swimming aid device.
Figure 4:
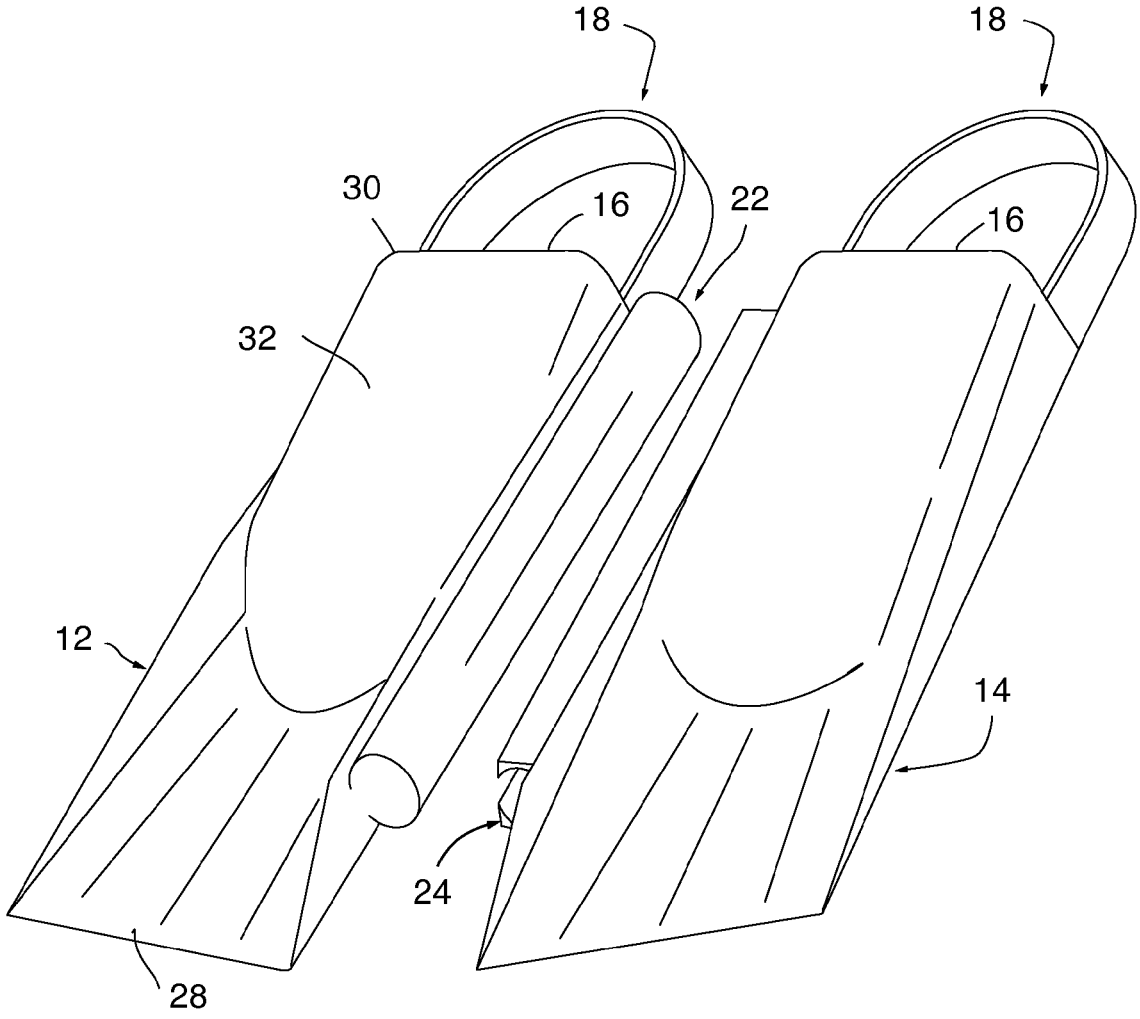
FIG. 4 is a 45 degree top down perspective of the swimming aid device.

Turning now to the embodiment of FIG. 1, the swimming aid device 10 of the present invention comprising a first fin 12, a second fin 14, internal opening spaces 16 capable of receiving the wearer's feet, a plurality of feet support straps 18, a coupling means 20 consisting of a rail 22 and a track 24. FIG. 2 shows the coupling means 20, consisting of a rail 22 and track 24 in a non-coupling position. As also clearly seen in FIG. 2, in one contemplated embodiment, the coupling means 20 includes a locking means which consists of a longitudinal lip 34 located on the end of the either the front or back end of the rail 22, that sufficiently prevents detachment of the rail 22 from the track 24, and contains a locking means for selective locking of the rails 22 to the track 24 to prevent further unwanted sliding movement between the rail 22 and the track 24. FIG. 2 depicts the longitudinal lip 34 on the front end of the rail 22. Said longitudinal lip 34 has a corresponding receiving groove 36 in the track 24, which has a pre-determined size and distance which after a certain distance, prevents the longitudinal lip 34 and rail 22 from further unwanted movement along the track 24. As seen in FIG. 3, the first fin 12 is coupled to the second fin 14 by slidably connecting the track 22 of the first fin 12 to the track 24 of the second fin 24. The rail 24 of the second fin 14 having an inner concaved groove 26 which slidably receives the track 22 of the first fin 12. FIG. 4 shows the swimming aid device 10 having an angled slope which generally reduces friction in the water by allowing the water to efficiently pass over and around the upper body 32 of the swimming aid device 10. From the proximate end 30 to the distal end 28 of each individual swim fin 12 and 14, one contemplated embodiment has an angled slope between 15-45 degrees.

Figure 5:
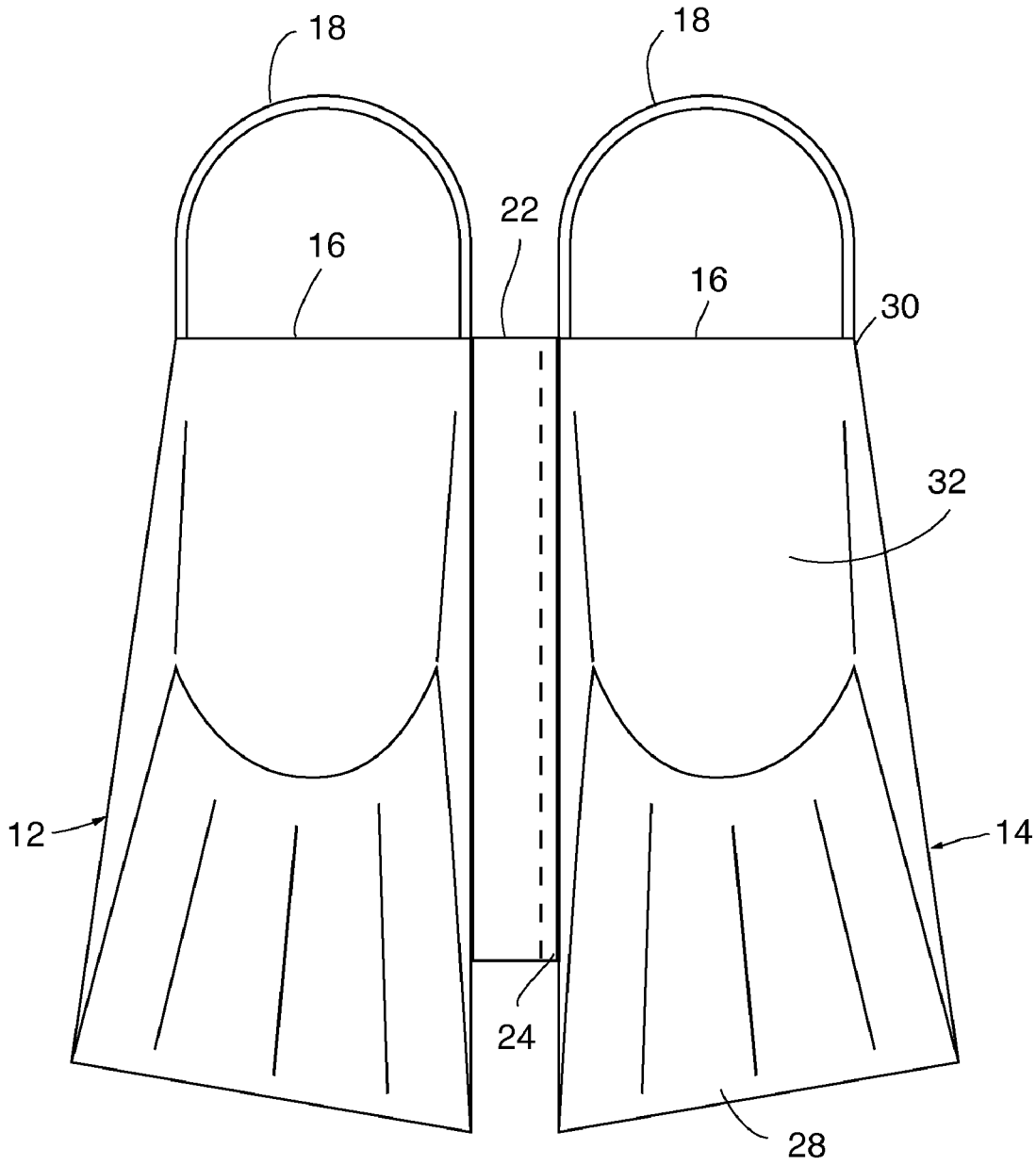
FIG. 5 is a top down view of the swimming aid device after attachment.
Figure 6:
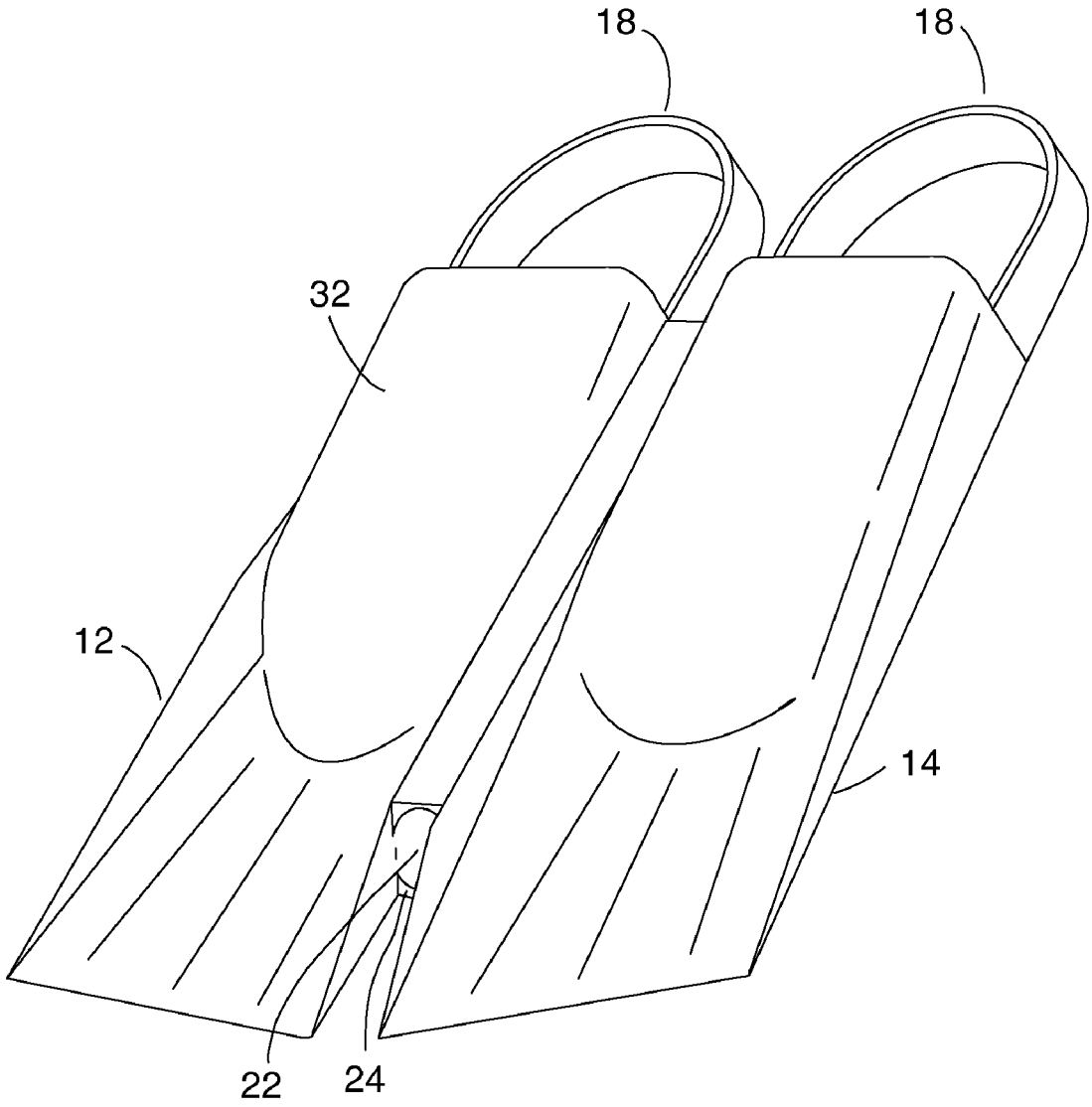
FIG. 6 is a 45 degree top down perspective of the swimming aid device after attachment.
Figure 7:
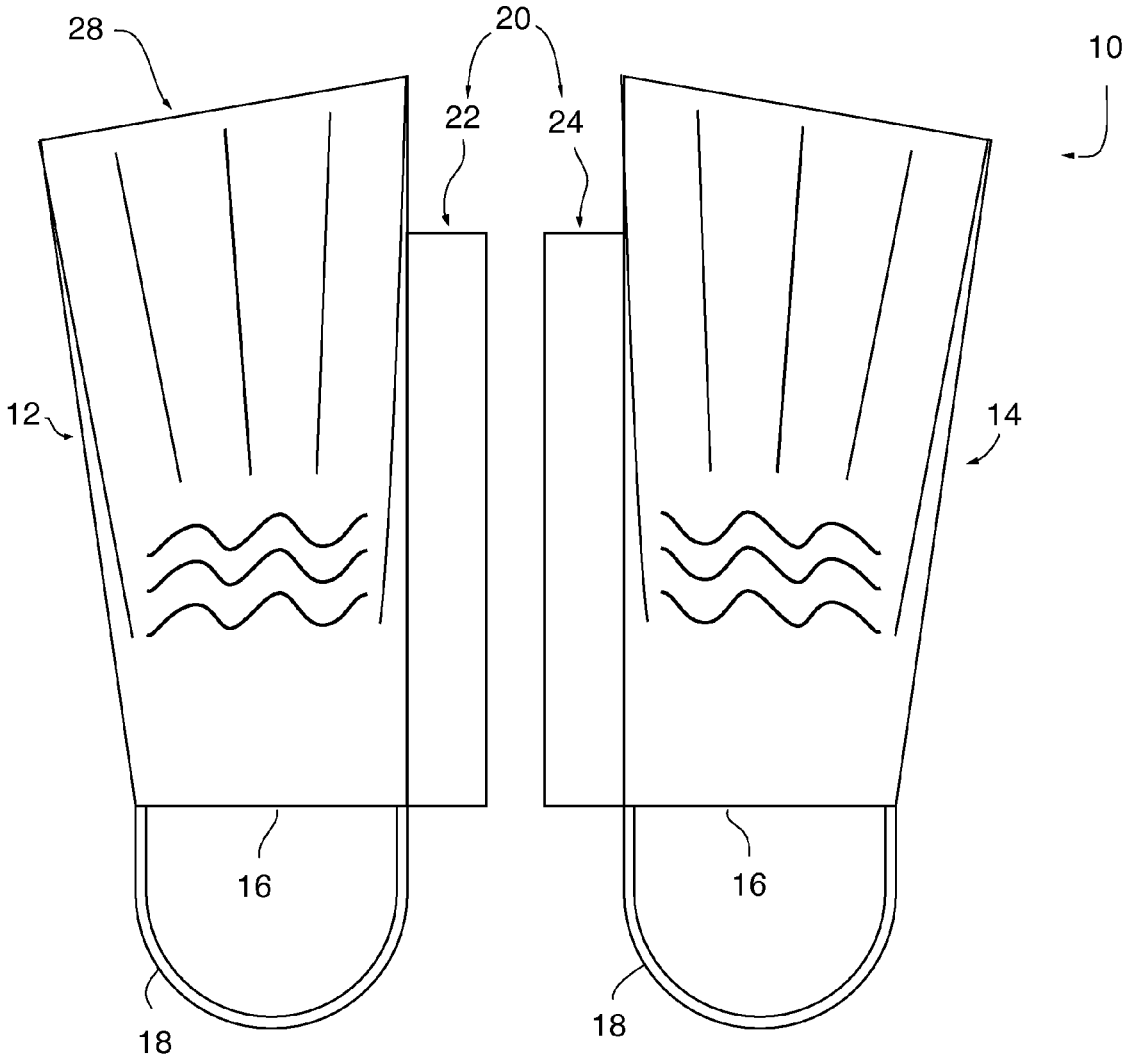
FIG. 7 is a bottom view of the swimming aid device.
Figure 8:
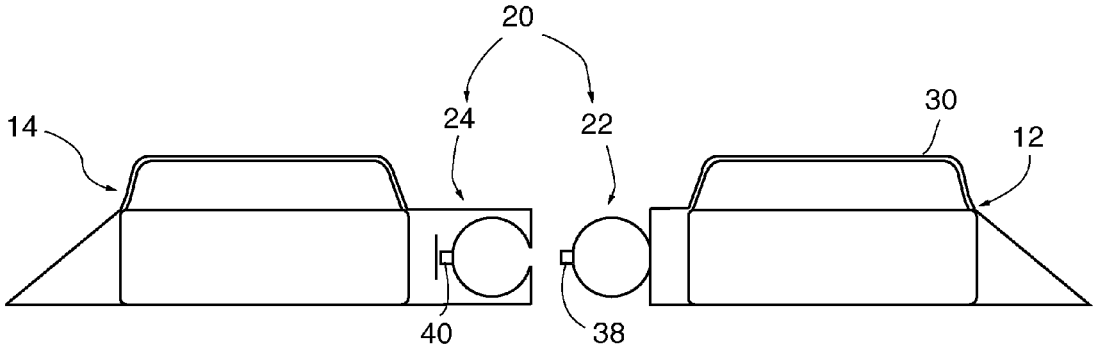
FIG. 8 is a back view of the swimming aid device showing an embodiment of the coupling means.

FIG. 5 and FIG. 6 shows in one embodiment, how the rail 22 and track 24 of the coupling means 20 appears after coupling. FIG. 7 shows the bottom view of the swimming aid device 10 before coupling. FIG. 8 shows the back view of the swimming aid device 10 before coupling. In addition, FIG. 8 shows another possible embodiment of the location of the longitudinal lip 38 and corresponding receiving groove 40 of the above mentioned locking means which is positioned on the back end of the rail 22 and track 24.

Figure 9:
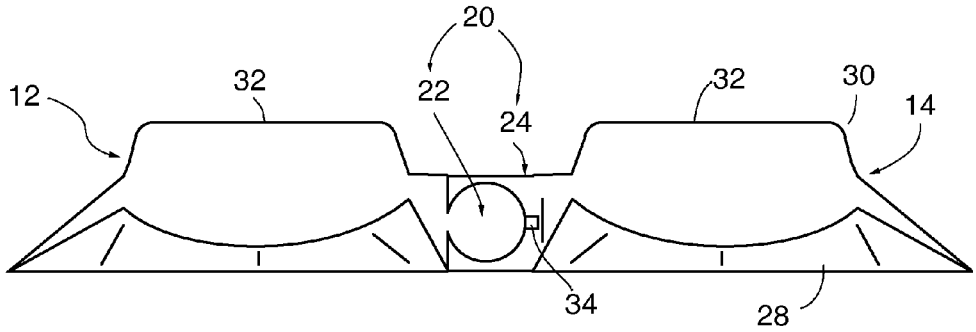
FIG. 9 is a front view of the swimming aid device showing the swimming device after attachment.
Figure 10:
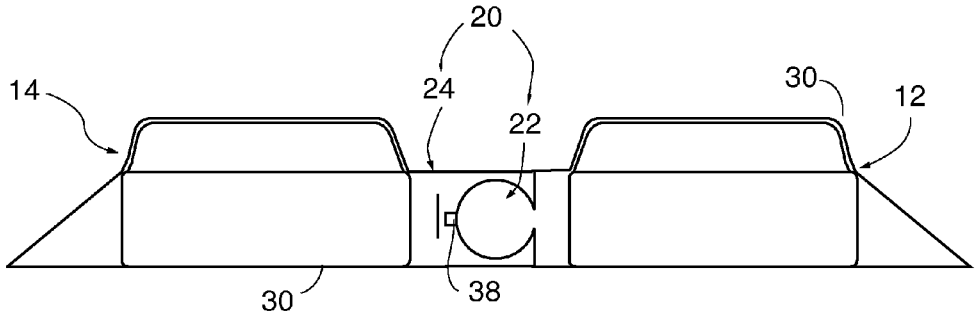
FIG. 10 is a back view of the swimming aid device showing the swimming device after attachment.

FIG. 9 depicts the front view coupling means 9 of swimming aid device 10 after coupling. In this contemplated embodiment, the longitudinal lip 34 of the locking means is on the front end of the rail 22 as can be clearly seen in FIG. 9 FIG. 10 depicts the back view coupling means 9 of swimming aid device 10 after coupling. FIG. 10 also depicts the longitudinal lip 38 in an alternative embodiment being located on the end of the rail 22.

Figure 11:
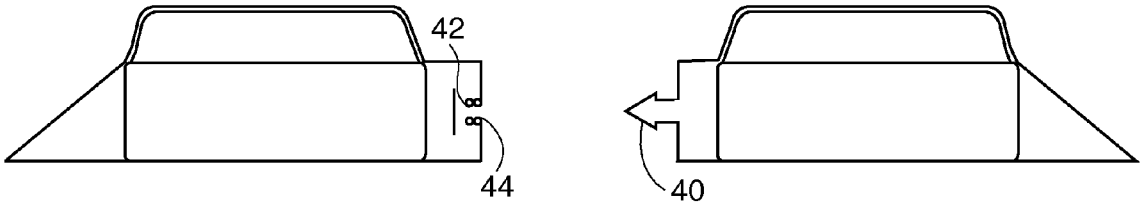
FIG. 11 is a back view of an alternate embodiment of the coupling means for the swimming aid device before coupling.
Figure 12:
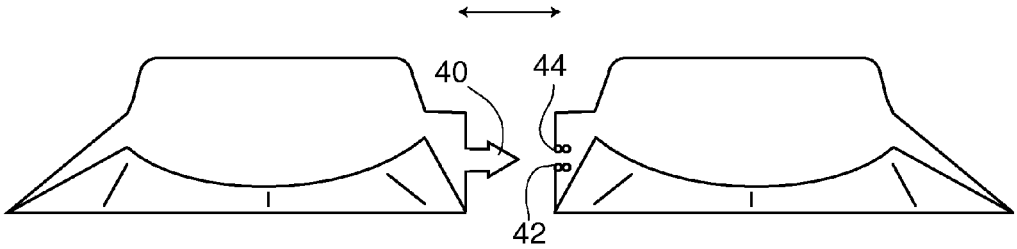
FIG. 12 is a front view of an alternate embodiment of the coupling means for the swimming aid device before coupling.
Figure 13:
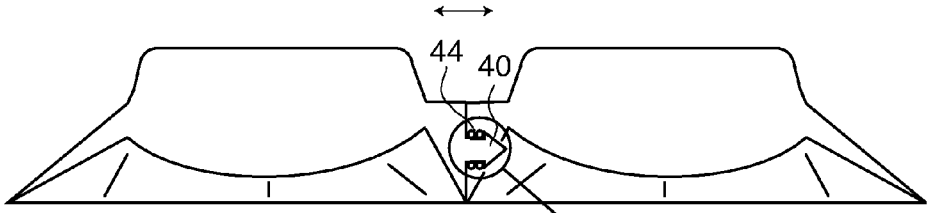
FIG. 13 is a front view of an alternate embodiment of the coupling means for the swimming aid device after coupling.
Figure 14:
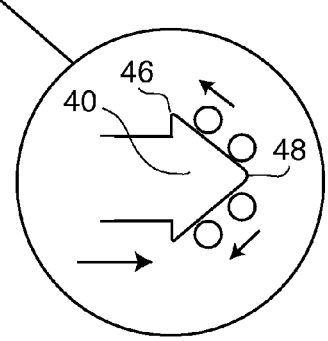
FIG. 14 is a blown up view of an alternate embodiment of the coupling means.

FIGS. 11, 12 and 13 illustrate front and back views of an alternate embodiment of the coupling means consisting of a pointed-tip like member 44 on one respective swim fin and a plurality of rounded-type members 42 on an opposing swim fin that allows the pointed-tip like member 40 to easily roll or maneuver through a small opening 42 in the swim fin that contains a plurality of rounded-type members 42. In one contemplated alternate embodiment, the plurality of rounded-type members 44 are positioned on the top and bottom of the opening 42. The pointed-tip like member 40 having an angled position creating a slight slope in which the proximate end 46 contains a slight raised indention and where the distal end 48 is slanted in a way to create a tip or a point. As shown in FIG. 14, because of the configuration of the pointed-tip like member 40, when pressure is exerted into the opening 42, the plurality of rounded-type members 44 are separated and raised to allow the pointed-tip like member to pass through the opening 42. After passage, the rounded-like members 44 will collapse back down to its natural state and position themselves adjacent to the proximate end 46 of the pointed-tip like member 40, whereas preventing further unwanted movement of the swim fins and unwanted de-attachment of the swim-fins.

Figure 15:
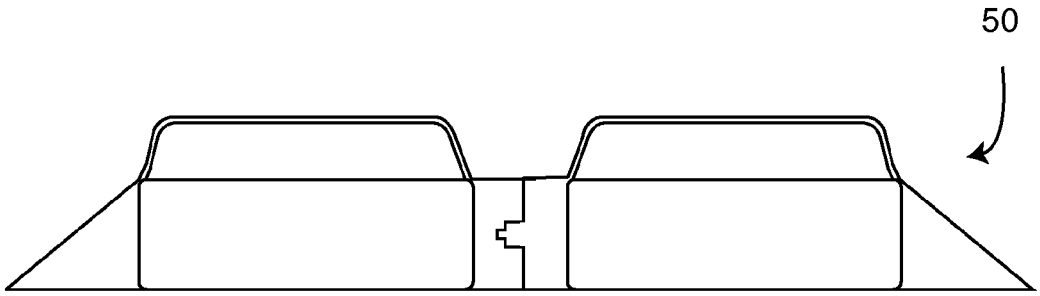
FIG. 15 is a back view of an alternate embodiment of the coupling means for a detachable mono fin.
Figure 16:
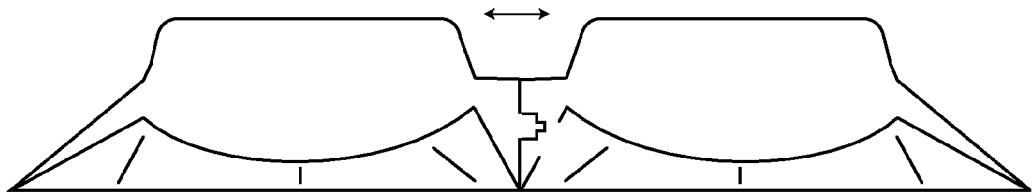
FIG. 16 is a front view of an alternate embodiment of the coupling means for a detachable mono fin.
Figure 17:
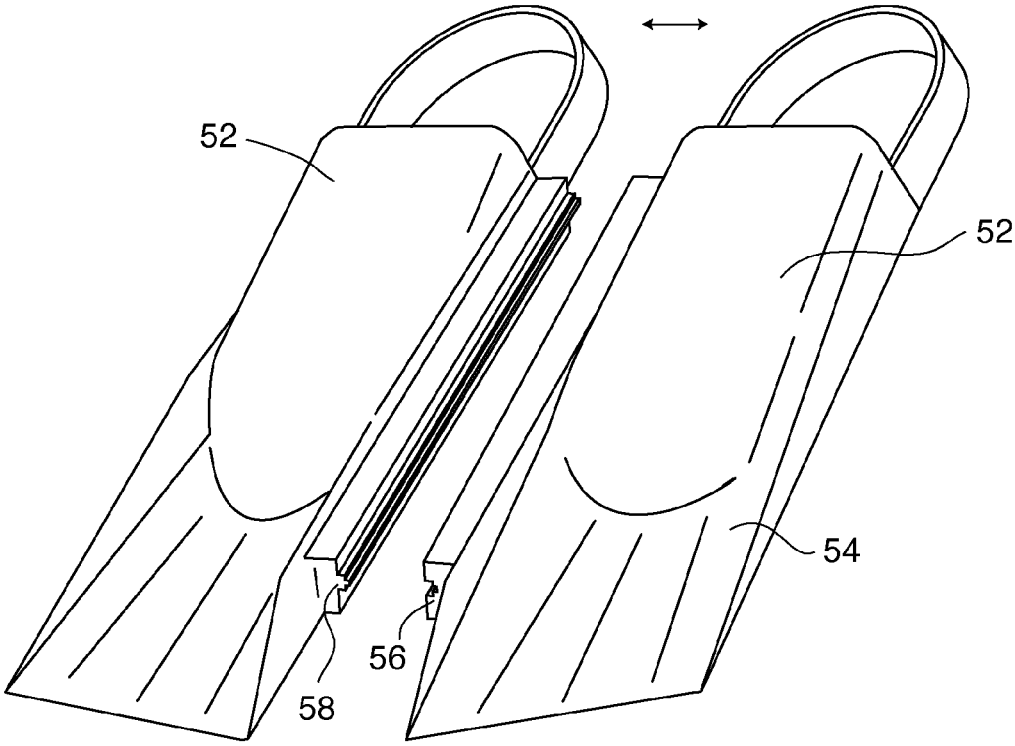
FIG. 17 is a 45 degree top-down perspective of an alternate embodiment of the coupling means for a detachable monofin after detachment.
Figure 18:
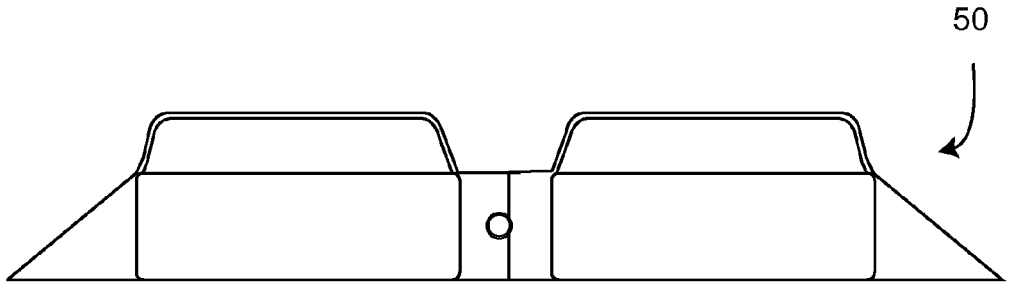
FIG. 18 is a back view of an alternate embodiment of the coupling means for a detachable mono fin after attachment.
Figure 19:
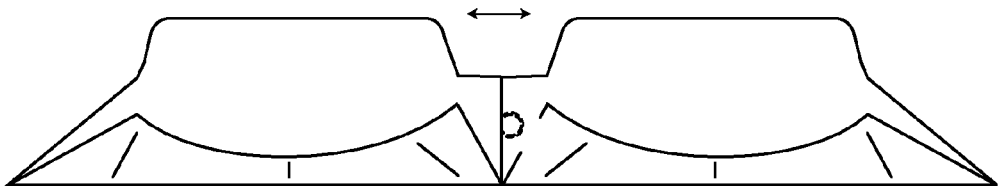
FIG. 19 is a front view of an alternate embodiment of the coupling means for a detachable mono fin after attachment.
Figure 20:
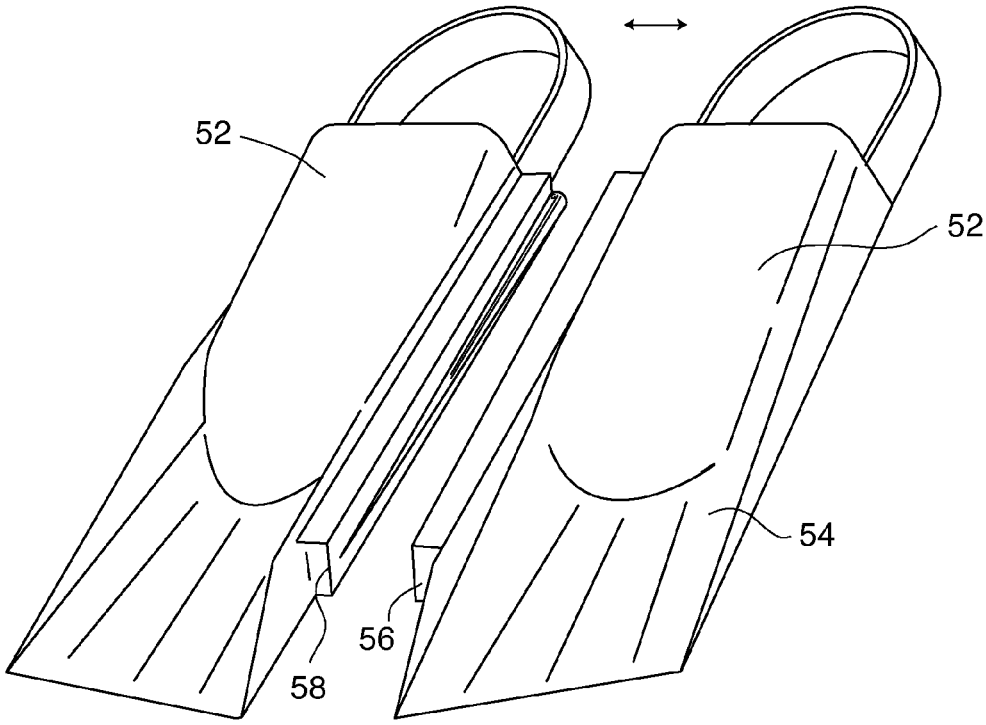
FIG. 20 is a 45 degree top-down perspective of an alternate embodiment of the coupling means for a detachable monofin after detachment.
Figure 21:
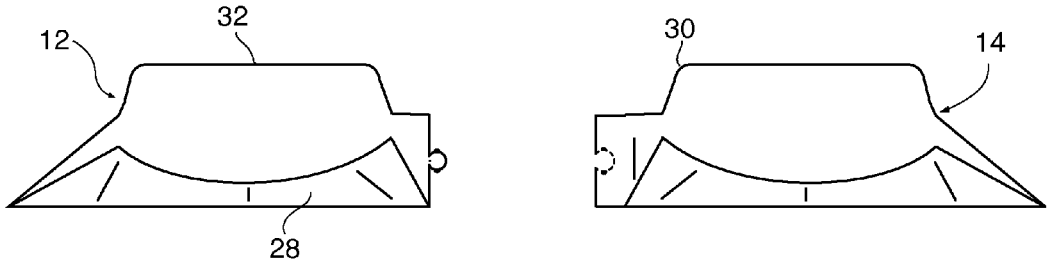
FIG. 21 is a front view of an alternate embodiment of the coupling means for a detachable mono fin before attachment.
Figure 22:
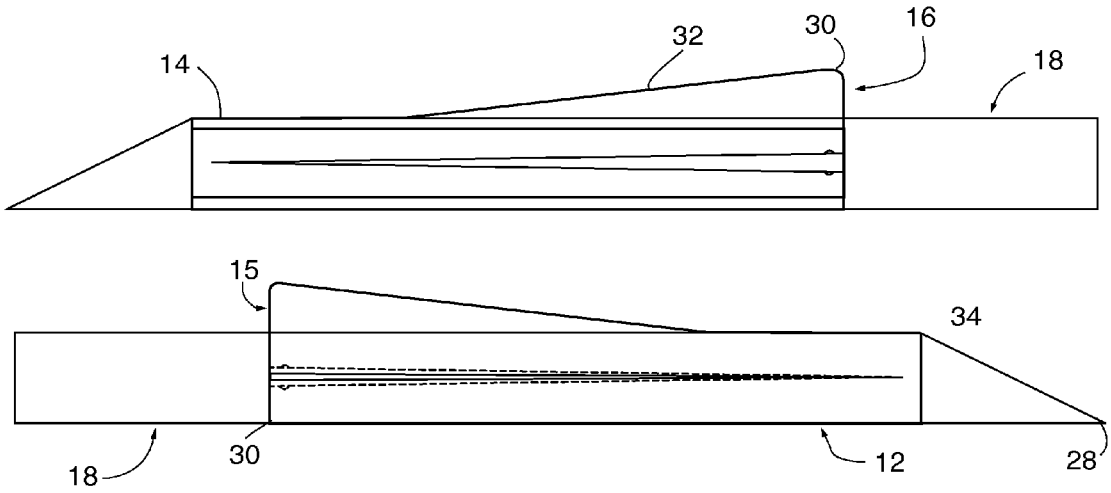
FIG. 22 are side views of the alternate embodiment of the coupling means for a detachable mono fin before attachment.

FIGS. 15, 16, 17 illustrates another embodiment of the present invention in which a detachable mono fin 50 for swimming comprising a main body 52; a main fin 54 disposed on a distal end of said main body 52; wherein a left portion 56 of the main body is detachable from a right portion 58 of the main body; a left foot pocket disposed on said left portion; and a right foot pocket disposed on said right portion. The monofin, wherein said left portion 56 and right portion 58 each has a structure complementary to the other, allowing a user to attach and detach said left portion from said right portion. The monofin, wherein said left portion 56 and right portion 58 are detached from each other, said main fin is separated into a left fin and a right fin. The monofin, wherein the complementary structures provide sufficient rigidity in coupling left portion and right portion together such that the two portions align substantially on the same plane and the main fin is substantially planar. The complementary structure is disposed on the inner side of each of said left and right portions. The monofin, wherein the complementary structure can include a variety of embodiments including a track and a rail, wherein the rail slidably receives within the track, and or other interlocking components such that may include male and female components. The monofin, further comprising at least one indentation disposed on at least one of said rail and track, and further comprising a least one notch disposed on at least one of said rail and track, such that when said left and right portions are coupled, at least one notch makes mating contact with at least one indentation to lock said left and right portions together. The track is disposed along at least 50% of a longitudinal length of the inner side. FIGS. 18-22 illustrate another contemplated embodiment of the coupling feature in the present invention. As shown in FIG. 20, the coupling feature consisting of a left portion 56 and right portion 58, whereas the coupling feature consists of a rail and track feature whereas the rail consists of cone-shaped like feature with a corresponding track and groove to receive said cone-shaped like rail. Said cone-shaped like rail would also consists of a locking means as seen and described above in FIG. 2.

In typical use, the user inserts his/her feet into the internal opening spaces 16 and at that time decides whether to use the swimming aid device 10 as traditional individual swim fins or use the coupling means 20 to combine the swimming aid device 10 into a mono-fin. For example, if a swimmer wanted to practice the swimming form typically referred to as "freestyle," the swimmer would use the swimming aid device as traditional individual swim fins because such forms as the "freestyle" require the independent use of each leg to properly "kick" or propel the swimmer forward. Alternatively, should the swimmer desire to practice a swimming form such as the "butterfly," which requires both feet to act in unison to successfully perform swim kicks such as a "dolphin kick," the swimmer would simply use the coupling means 9 to attach or combine the individual swim fins into one mono-fin swimming aid device. In the present embodiment, where the coupling means 20 consists of a rail 22 and track 24, to attach or combine the individual swim fins, the swimmer would manually slide the rail 22 of the first fin 12, into the groove 26 of track 24, which is attached to the second fin 14. To detach the swim fins, the swimmer would simply reverse the former steps.

Thus, specific embodiments and applications of the swimming aid device have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A swimming aid device, comprising:

a first fin;

a second fin;

a locking means;

wherein each of said fins has an internal space capable of enclosing a portion of a wearer's foot;

wherein each of said fins has an opening leading to said internal space capable of allowing a wearer to insert a foot through said opening;

coupling means for detachably coupling said first fin to said second fin, said coupling means includes a track and a rail, wherein said track is disposed on a lateral side of said first fin and has a groove running in a longitudinal direction substantially parallel to a longitudinal axis of said track, said groove slidably receives said rail, and said rail is disposed on a lateral side of said second fin;

wherein said track has at least one longitudinal lip that sufficiently prevents detachment of said rail from said groove in a direction perpendicular to said longitudinal direction;

wherein said locking means prevents further relative sliding movement between said rail and said groove, and said locking means includes a slot and an indentation, said slot is disposed on one of the two fins, and said indentation is disposed on one of the two fins complementally to the slot, wherein when said rail is fully received within said groove, said indentation aligns with said slot, and is caught by said slot;

wherein said slot and said indentation are each complementally located at one of two terminal ends of said track or said rail; and wherein said fins are made of resilient material.

2. The swimming aid device of claim 1, wherein the track and the rail allow the first and second fins to form a monofin, wherein the coupling is sufficiently strong so as to allow a wearer to use the monofin underwater for fin swimming.

3. A detachable monofin for fin swimming, comprising:

A main body;

a main fin disposed on a distal end of said main body;

wherein a left portion of the main body is detachable from a right portion of the main body;

a left foot pocket disposed on said left portion;

a right foot pocket disposed on said right portion;

wherein said left foot pocket and right foot pocket have internal spaces capable of enclosing a portion of a wearer's foot;

wherein said left foot pocket and right foot pocket have openings leading to said internal spaces capable of allowing a wearer to insert feet through said openings;

coupling means for detachably coupling said left portion to said right portion wherein said coupling means includes a pointed-tip member on one of said left and said right portion and a plurality of rounded members attached on a small opening of an other one of said left and said right portion complementally opposite to the pointed-tip member, said pointed-tip member is configured to have a distal end and a proximate end forming an arrowhead structure having a slight slope, when inserting said distal end of said pointed-tip member into said small opening, a pressure is exerted moving said plurality of rounded members upward allowing said pointed-tip member to pass through till said proximate end and said pointed-tip member are at a locking position; and wherein said fins are made of resilient material.

4. The monofin of claim 3, wherein when said left portion and right portion are detached from each other, said main fin is separated into a left fin and a right fin.

5. The monofin of claim 4, wherein the coupling means provides sufficient rigidity in coupling left portion and right portion together such that the two portions align substantially on the same plane and the main fin is substantially planar.

6. The monofin of claim 5, wherein the coupling means is disposed on the inner side of each of said left and right portions.

* * * * *